US005509652A

United States Patent [19]

Woronets

[11] Patent Number: 5,509,652

[45] Date of Patent: Apr. 23, 1996

[54] HOCKEY PRACTICE ALLEY

[76] Inventor: Eli M. Woronets, 4890 Gardenia St., Oceanside, Calif. 92057

[21] Appl. No.: 380,649

[22] Filed: Jan. 30, 1995

[51] Int. Cl.[6] ..... A63B 69/00

[52] U.S. Cl. ..... 273/57.2

[58] Field of Search ..... 273/57.2, DIG. 4

[56] References Cited

U.S. PATENT DOCUMENTS

| | | | |
|---|---|---|---|
| 1,962,899 | 6/1934 | Hagy | 273/51 |
| 3,572,717 | 3/1971 | Anguella | 273/126 |
| 3,709,489 | 1/1973 | Holleran et al. | 273/57.2 |
| 3,762,711 | 10/1973 | Cooper | 273/126 R |
| 3,765,675 | 10/1973 | DiMarzio | 273/57.2 |
| 4,513,964 | 4/1985 | Gunderson | 273/126 R |
| 4,607,842 | 8/1986 | Daoust | 273/57.2 |
| 5,246,229 | 9/1993 | Carey | 273/57.2 X |

FOREIGN PATENT DOCUMENTS

| | | | |
|---|---|---|---|
| 1207811 | 7/1986 | Canada . | |
| 2086130 | 6/1993 | Canada | 273/57.2 |

*Primary Examiner*—William H. Grieb
*Attorney, Agent, or Firm*—Presseissen & Reidelbach

[57] ABSTRACT

The present invention provides a hockey practice alley for developing and improving the skills of a hockey player. This is accomplished by utilizing a low friction hockey shooting surface supported by a platform. The shooting surface exhibits characteristics comparable to an actual ice hockey rink allowing regulation play equipment to be used for simulating hockey game conditions. The shooting surface extends from a first end to a second end, with a goal structure positioned proximate to the second end and one or more hockey players positioned proximate to the first end. The goal structure may be rotatably mounted on the shooting surface for simulating a variety of angle shots while allowing the hockey player to select a stationary position on the platform.

26 Claims, 3 Drawing Sheets

HOCKEY PRACTICE ALLEY

BACKGROUND OF THE INVENTION

1. Field of the Invention

The present invention relates generally to an apparatus for practicing ice hockey, and more particularly to a hockey practice alley for developing and improving the skills of a hockey player.

2. Description of the Related Art

The development of hockey skills for the average ice hockey player is often haphazard and inadequate. Ideally, the development of hockey skills should include isolating individual weaknesses and taking remedial action in the form of practice, preferably under conditions comparable to actual regulation ice hockey play.

In the past, the practice of ice hockey has taken place in several different and distinct environments. One environment is inside an enclosed building which utilizes a controlled system for maintaining a large iced surface, such as a conventional ice hockey rink. Another environment is outside within the natural elements, such as a lake or pond which has frozen over. Still another environment is a substantially flat iceless surface such as concrete, asphalt, wood, linoleum and the like. There exists many disadvantages to the use of these types of environments for isolating individual weaknesses and taking remedial action in the form of practice.

The use of a controlled environment facility, such as a regulation size ice hockey rink, for practicing ice hockey is ideal for simulating real hockey game conditions. However, the use of such a facility is impractical for the average, non-professional hockey player.

One obvious reason why such an environment is impractical is that its use involves a relatively large building with very expensive equipment to form the ice and maintain it in the appropriate iced condition. Additionally, individual practice is often precluded because a player can tie up a substantial area of the ice hockey rink attempting to diagnose and correct a particular shortcoming. The simultaneous use of an ice hockey rink by a group of hockey players can also lead to unsafe practicing conditions. As a result, the use of a controlled environment for isolating individual weaknesses and taking remedial action in the form of hockey practice is not an acceptable alternative.

This leads some potential hockey players outdoors to natural areas of large ice deposits, such as lakes and ponds. The use of this type of environment for practicing hockey is also problematic. In addition to being unavailable to a significant population of potential hockey players who reside in climatically more temperate areas, natural ice deposits are typically seasonal. Consequently, individual players are projected into competitive games before their skills have been fully developed through adequate practice. Most often, the playing season is over before the individual player has had sufficient practice to reach his peak proficiency.

Finally, due to the unavailability of the prior environments in which to practice hockey, many would be hockey players migrate to common flat iceless surfaces such as concrete, asphalt, wood, linoleum and the like. Because these surfaces tend to be too rough for the use of conventional regulation hockey equipment, specialized equipment must be substituted. For example, pucks formed of resistive polyethylene rather than conventional hard vulcanized rubber are used.

Unfortunately, the use of substituted non-regulation equipment significantly alters and distinguishes hockey practice from regulation hockey game conditions. Consequently, an apparatus for isolating individual weaknesses and taking remedial action in the form of practice in conditions comparable to regulation ice hockey play remains undeveloped.

SUMMARY OF THE INVENTION

The purpose of the present invention is to provide an all weather hockey practice apparatus for developing and improving the launching, shooting and passing skills of a hockey player. The apparatus may be placed indoor or outdoor and used in any climate or weather condition. This is accomplished in part by utilizing a low friction hockey surface which resembles the characteristics of an iced surface such as an actual ice hockey rink.

It is another purpose of the present invention to provide remedial action in the form of hockey practice by allowing the isolation of a players weaknesses. This is accomplished by simulating a variety of angle shots while allowing the hockey player to maintain a stationary position on the hockey surface.

It is yet another purpose of the present invention to provide a safe and cost effective method for practicing hockey, while reducing the space required for individual practice.

In a preferred embodiment, the apparatus includes a platform for supporting a stationary shooting surface. The surface extends from a first end to a second end, which can be of any desired length and width. The shooting surface is made of a high impact low friction plastic or fiberglass material to simulate an actual ice surface.

A goal structure is rotatably mounted on the shooting surface near the second end. The goal structure includes a goal frame having an opening for receiving a hockey puck, and a netting material attached to and draped across the back side of the frame. The goal frame opening is rectangular in shape and may be sized to fit an particular need. For purposes of clarity, the goal frame in the preferred embodiment is regulation sized having inside dimensions of approximately 4 feet in height and 6 feet in width. A deflective panel is positioned above the shooting surface and attached to the goal frame to deflect the hockey puck away from the goal frame opening. The panel may be shaped and have an image affixed thereon to simulate the presence of a goaltender.

The goal frame is rotated at various angles by a drive mechanism. The platform maintains a stationary position throughout the movement or rotation of the goal frame, thus simulating a wide variety of hockey shots.

The method of developing the hockey skills of a hockey player includes positioning a hockey player near the first end of the shooting surface and shooting a hockey puck toward the goal frame opening. A successful shot is defined by a hockey puck passing through the goal frame opening around the perimeter of the deflective panel.

These and other features and advantages of the invention will be apparent to those skilled in the art from the following detailed description, taken together with the accompanying drawings, in which:

DETAILED DESCRIPTION OF THE INVENTION

Figure 1:
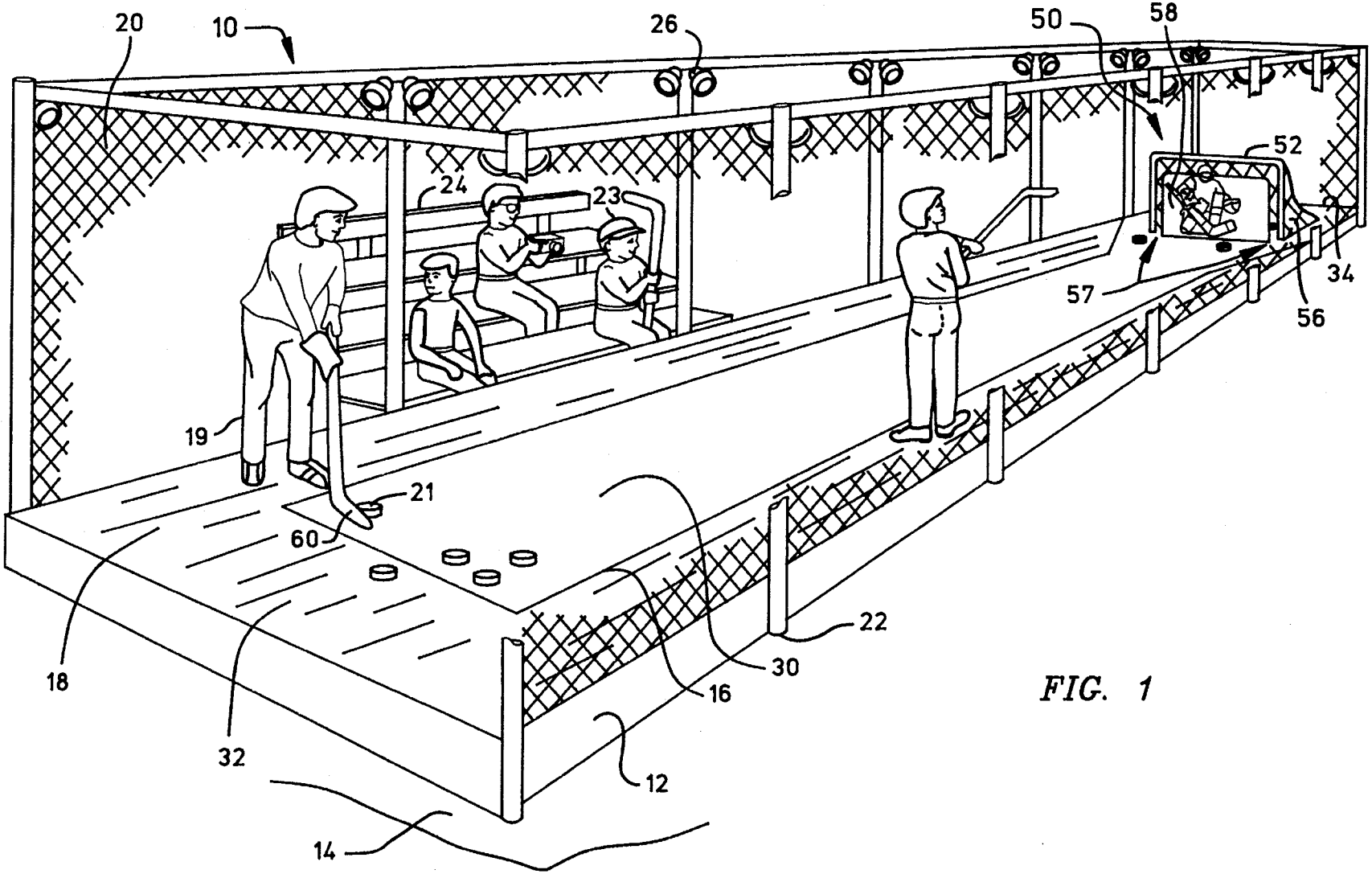
FIG. 1 is a perspective view of the hockey practice alley.

As illustrated in FIG. 1, a hockey practice alley 10 embodying the present invention includes a platform 12 erected on a substantially flat ground plane 14. The ground plane 14 may consist of natural soil, concrete, asphalt, wood, linoleum or the like. The platform 12 may be constructed of any sturdy material such as wood, metal, or hard plastic. To simulate actual hockey game conditions, platform 12 preferably has a width of between 12 feet and 18 feet, and a length of between 60 feet and 100 feet. The present invention contemplates a wide variety of platform 12 constructions and configurations and is not limited to the particular dimensions above mentioned.

The platform 12 is designed to support a hockey shooting material 16, and to provide aisles 18 which surround the perimeter of shooting material 16 for providing desired positioning of one or more hockey players 19.

Although not required for the present invention, several features may be added to enhance the useability of the hockey practice alley 10. For example, a containing material 20 made of netting or caging may surround the perimeter of platform 12 to provide added safety for observers 23. In FIG. 1, the containing material 20 is a metal cage supported against platform 12 by frame supports 22 attached or braced to platform 12. In addition, bleachers 24 may be located around the outside perimeter of the containing material 20 as desired, along with lighting 26 mounted at the top of frame supports 22 for illumination during hockey practice. The present invention also contemplates placing multiple hockey practice alleys 10 adjacent to one another in an enclosed building to provide an entertainment center.

As shown in FIG. 1, the hockey shooting material 16 has a top surface 30 which is substantially flush with the surface of aisles 18 of platform 12. The shooting material 16 may be sized to any desired length or width. For purposes of clarity, the shooting material 16 of the preferred embodiment has a length of between 60 feet and 100 feet extending from a first end 32 to a second end 34. The shooting material 16 may be continuous or sectioned along its length.

Figure 2:
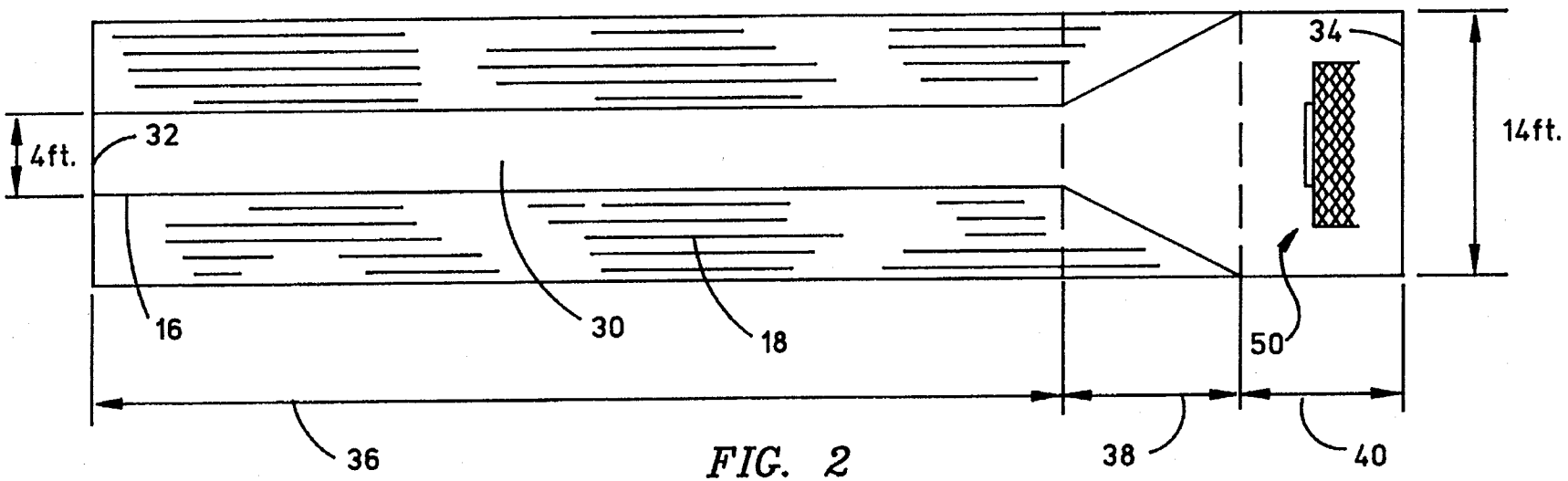
FIG. 2 is a plan view of the hockey practice alley.

For illustration purposes only, FIG. 2 shows the shooting material surface 30 broken down into three respective sections 36, 38, 40. The first section 36 has a length of approximately 63.5 feet and a continuous width of approximately 4 feet throughout its length. The second section 38 has a length of approximately 5 feet and a width tapering from 4 feet to 14 feet along its length. Finally, a third section 40 has a length of approximately 10 feet and a continuous width of approximately 14 feet throughout its length.

The shooting material 16 can be formed from a wide variety of material known in the art for providing an ice like or relatively friction free surface, such as plastic or fiberglass. The characteristics of the material used should be defined as high impact, durable, all weather, low-friction, and smooth. One important purpose of using such a surface is to allow regulation play hockey equipment (i.e. regulation hockey sticks and pucks) to be used during hockey practice to closely simulate actual ice hockey playing conditions. Plastic material, known in the art as cellulose, acrylonitrile butadiene styrene (ABS), polyethylene, acrylic, polystyrene, and polypropylene have been shown to be suitable for forming the shooting material surface 30. Preferably, an ultra high molecular weight polyethylene is used which may be obtained in sheet form from various manufacturers such as ULTRA POLY, Inc. having an address of 2926 South Steele St., Tacoma, Wash. 98409.

A goal structure 50 may be fixedly or movably positioned or mounted on the shooting material surface 30. Preferably, the goal structure 50 is placed within the third section 40 proximate to the second end 34, as shown in FIG. 2.

Figure 3:
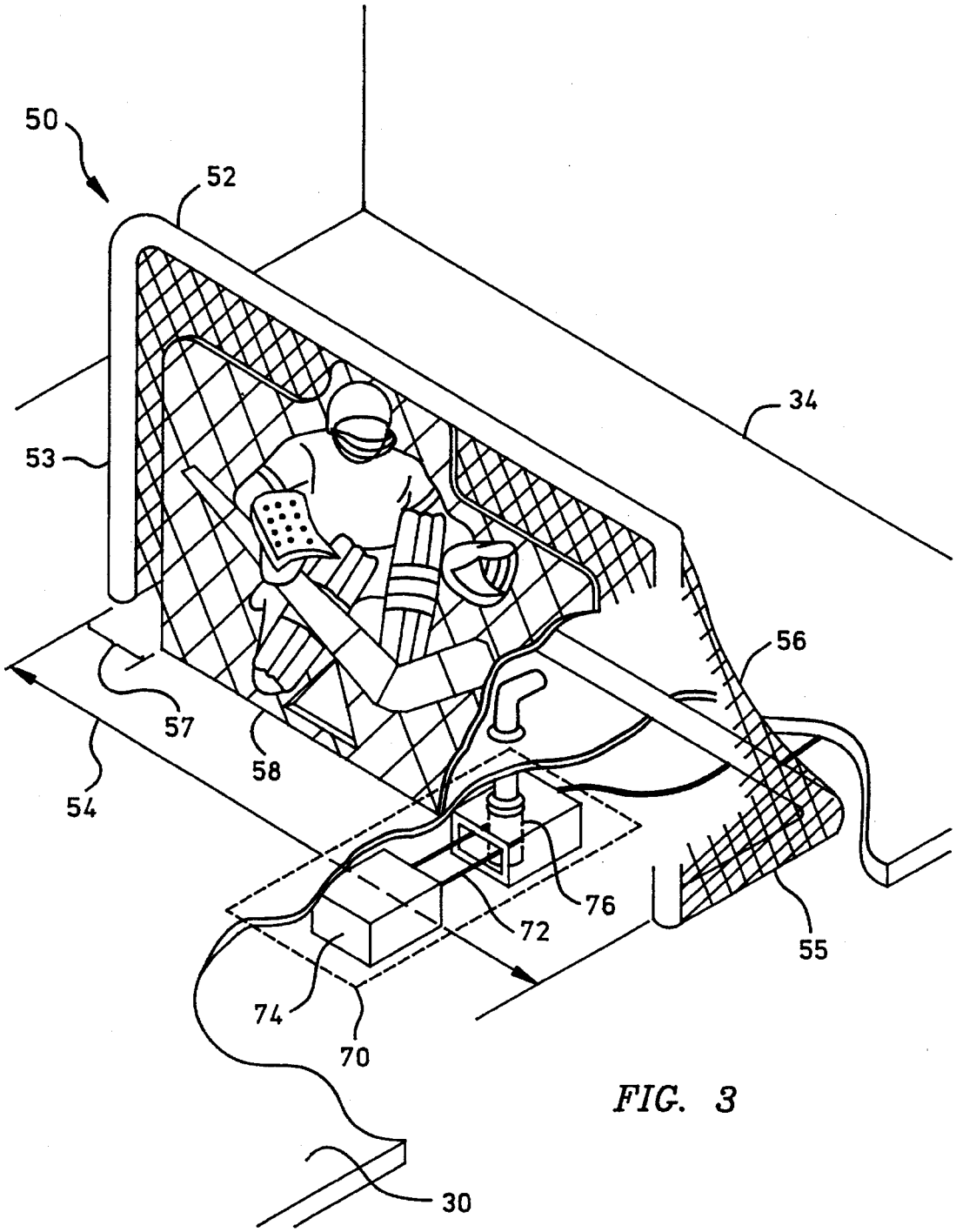
FIG. 3 is a cut-away view illustrating the drive mechanism for rotating the goal frame.

Referring to FIG. 3, the goal structure 50 consists of a goal frame 52 having a vertical frame portion 53 positioned substantially perpendicular to shooting material 16 and a horizontal frame portion 55 positioned substantially parallel to shooting material 16. The frames of both portions 53 and 55 are "U" shaped and may be attached by any means well known in the art to form the goal frame 52. When combined, the frames 53, 55 resemble the letter "L" when viewed from either side of the goal structure 50. Preferably, the goal frame 52 is constructed of tubular steel or aluminum although many other types of material may be suitable for use. The vertical frame portion 53, shaped in an upside down "U," defines the dimensions of goal frame opening 54. The goal frame opening 54 may be designed for any desired size. However, for consistency with regulation sized hockey goals, the goal frame opening 52 preferably has dimensions of 4 feet in height and 6 feet in width. The horizontal portion 55 is designed to provide the necessary support for maintaining the vertical frame portion 53 in its appropriate upright playing position.

As illustrated in FIGS. 1 and 3, a netting material 56, preferably a heavy duty nylon mesh, is draped across and attached to back side of the goal frame 52 for capturing any hockey puck entering the goal frame opening 54. The netting material is preferably a heavy duty nylon mesh although any type of natural or synthetic netting construction may be used (e.g., cotton, fiberglass).

A deflective panel 58 is positioned above the shooting surface 30 and proximate to the goal frame 52. The deflective panel 58 may be fixedly or movably attached to the goal frame 52 for selectively blocking a portion of the goal frame opening 54. Panel 58 may be rotated or pivoted relative to frame 52 to simulate the movement of an actual goaltender. This can be accomplished by any means well known in the art.

The deflective panel 58 can be formed from high impact polyethylene or fiberglass as described above with respect to the shooting material 16, and can be shaped and/or printed on to resemble an actual goaltender. Preferably, the deflective panel 58 has dimensions of approximately 3 feet in width allowing for an unblocked frame opening 57 of approximately 1.5 feet on either side of the deflective panel 58. Although not shown, the deflective panel 58 may incorporate various sized apertures therethrough to reflect the area between a goaltenders pads. It is to be understood that the present invention contemplates a goal frame 52 and/or deflective panel 58 of various sizes and shapes, and is not limited to any particular goal structure 50 configuration.

As shown in FIG. 3, the goal structure 50 may be rotatably mounted on shooting surface 30 for simulating a variety of angle shots. A drive mechanism 70 is mechanically coupled to the goal frame 52 for rotating goal structure 50 with respect to the stationary shooting surface 30. More specifically, belt 72 driven by a stepper motor 74 turns a shaft 76 which in turn rotates goal frame 52. It is to be understood that any type of mechanical or electrical mechanism known in the art may be used to rotate the goal frame 52.

Figure 4B:
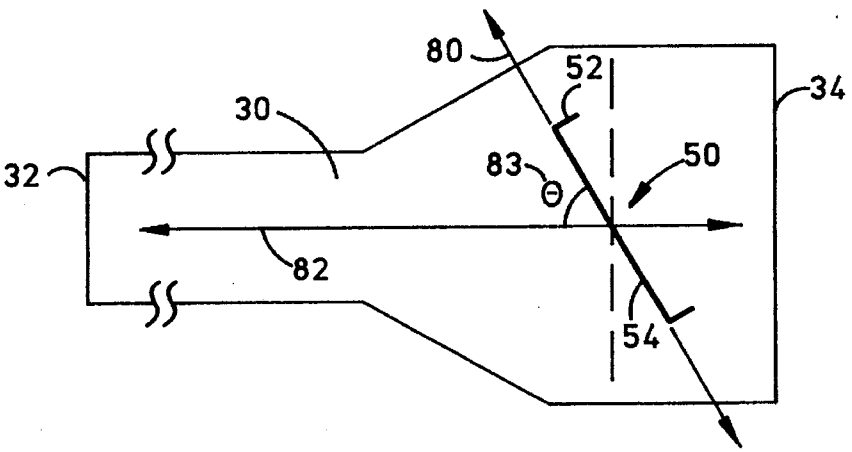
FIGS. 4A and 4B are plan views which illustrate the rotation of the goal frame relative to the platform.
Figure 4A:
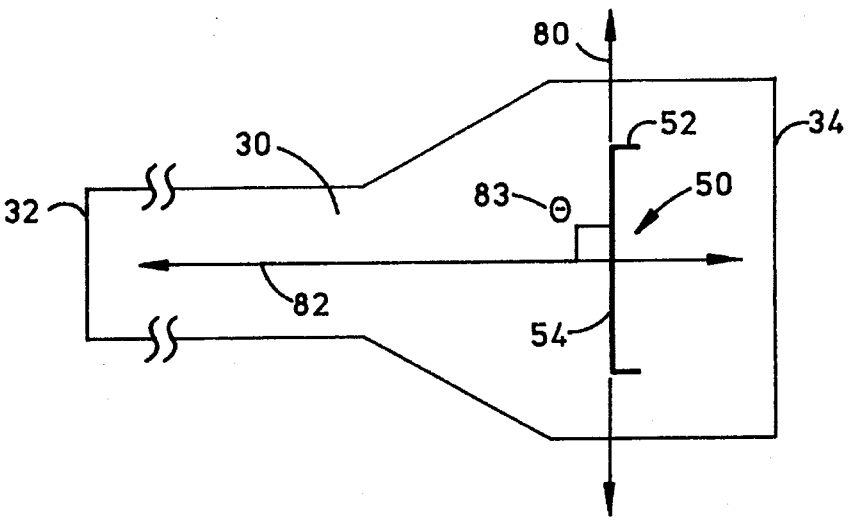

The rotation of goal frame 52 is exemplified in FIG. 4A and 4B. A goal line 80, defined as the x-axis, is a line extending across the shooting surface 30 along the goal frame opening 54. A shooting line 82 is defined as a center line extending along the length of the shooting surface 30 from the first end 32 to the second end 34. An angle theta (θ) 83 is defined as the angle created by the intersection of goal line 80 and shooting line 82.

The goal frame 52 may be rotated to simulate a variety of positions or coordinates on an actual regulation size hockey rink surface. In an initial state, shown in FIG. 4A, shooting line 82 is substantially perpendicular to goal line 80 forming an angle theta (θ) 83 of 90 degrees. When the goal frame 52 is in the initial position, only a narrow range of positions or coordinates on an actual hockey rink are simulated. As the goal structure 50 is rotated as exemplified in FIG. 4B, a broad range of positions or coordinates on an actual hockey rink are simulated. The hockey player 19 can select an appropriate distance from the goal structure 50 to simulate any angle point shot or any possible hockey rink position. Thus, if a hockey player 19 desired to practice shooting the puck from a particular position on a hockey rink, both the angle theta (θ) 83 and the distance of the hockey player 19 from the goal line 80 can be adjusted to select the desired position or coordinates. Using simple mathematics, a correlation can be made between the angle theta (θ) 83 and various hockey rink coordinates. For example, if the goal frame 52 is rotated such that angle theta (θ) 83 is 30 degrees, and the hockey player 19 is positioned approximately 60 feet from the goal line 80, it is as if the shot is taken from (x, y) coordinates of approximately (30 feet from the goal line 80, 52 feet from the center line 82) on an actual regulation size hockey rink. The adjustment of the frame angle theta (θ) may be made manually or automatically.

During practice, one or more hockey players 19 are positioned on the periphery of platform 12 on side aisles 18. The players 19 utilize regulation hockey sticks 60 to aim and shoot regulation hockey pucks 21 toward the opening 54 of goal structure 50. If the hockey puck 21 fails to pass through the opening 54, the hockey puck 21 will either be deflected by the deflective panel 58, or entirely miss the goal structure 50. In the event that the hockey puck 21 is deposited within the unblocked frame opening 57 of goal frame 52, then the hockey puck 21 will merely strike the netting material 56 which is held in position about the goal structure 50 by the goal frame 52.

While preferred embodiments of the invention have been shown and described, numerous variations and alternate embodiments will be apparent to those skilled in the art. Accordingly, it is intended that the invention be limited only in terms of the appended claims.

We claim:

1. An apparatus for practicing hockey techniques using a hockey puck and a hockey stick, comprising:

a shooting surface extending from a first end to a second end;

a goal frame rotatably mounted on said shooting surface proximate to said second end, said goal frame having an opening for receiving the hockey puck; and a means for rotating said goal frame relative to said shooting surface thereby simulating at least one angle shot.

2. An apparatus as recited in claim 1, further comprising a pre-shaped panel for deflecting the hockey puck away from said goal frame opening, said pre-shaped panel positioned above said shooting surface and proximate to said goal frame.

3. An apparatus as recited in claim 2, wherein said pre-shaped panel is fixedly attached to said goal frame.

4. An apparatus as recited in claim 2, wherein said pre-shaped panel is moveably attached to said goal frame.

5. An apparatus as recited in claim 2, wherein said pre-shaped panel has an image affixed thereon thereby simulating a goaltender.

6. An apparatus as recited in claim 1, wherein said shooting surface has a length of between 50 feet and 100 feet and width of between 4 feet and 14 feet.

7. An apparatus as recited in claim 1, wherein said shooting surface is made of a high impact low friction material thereby simulating an iced surface.

8. An apparatus as recited in claim 7, wherein said material is formed from plastic.

9. An apparatus as recited in claim 8, wherein said plastic is polyethylene.

10. An apparatus as recited in claim 8, wherein said plastic is acrylonitrile butadiene styrene (ABS).

11. An apparatus as recited in claim 7, wherein said material is formed from fiberglass.

12. An apparatus as recited in claim 1, further comprising a platform for supporting said shooting surface.

13. An apparatus as recited in claim 12, wherein said platform has an aisle surrounding a substantial portion of the perimeter of said shooting surface.

14. An apparatus as recited in claim 1, wherein said goal frame opening is rectangular in shape having inside dimensions of approximately 4 feet in height and 6 feet in width.

15. An apparatus as recited in claim 1, wherein said rotating means comprises a drive mechanism mechanically coupled to said goal frame for rotation of said goal frame relative to said shooting surface.

16. An apparatus as recited in claim 15, wherein drive mechanism further comprises:

a shaft fixedly attached to said goal frame;

a belt mechanically coupled to said shaft for movement of said goal frame; and a motor for selectively driving said belt.

17. An apparatus for developing the hockey skills of a hockey player, comprising:

a low friction shooting surface, said shooting surface extending from a first end to a second end;

a goal frame having an opening for defining a successful shot, said goal frame supported by said shooting surface; and a deflective panel, attached to said goal frame, for blocking a preselected portion of said goal frame opening.

18. An apparatus as recited in claim 17, further comprising a means for rotating said goal frame relative to said shooting surface.

19. An apparatus as recited in claim 17, wherein said shooting surface is formed from a plastic material.

20. An apparatus as recited in claim 19, wherein said plastic is polyethylene.

21. An apparatus as recited in claim 17, wherein said goal frame is formed from tubing.

22. An apparatus as recited in claim 17, further comprising a platform for supporting said shooting surface.

23. A method of developing the hockey skills of a hockey player, including the steps of:

providing a low friction shooting surface extending from a first end to a second end;

mounting a goal frame proximate to the second end of the shooting surface, said goal frame having an opening for defining a successful shot;

positioning the hockey player proximate to the first end of the shooting surface for aiming and shooting a hockey puck toward the goal frame opening; and rotating the goal frame relative to the shooting surface for simulating a variety of angle shots.

24. A method as recited in claim 23, further including the step of attaching a deflective panel to the goal frame for deflecting the hockey puck away from the goal frame opening.

25. An apparatus for developing the hockey skills of a hockey player, comprising:

a low friction shooting surface, said shooting surface extending from a first end to a second end;

a goal frame having an opening for defining a successful shot, said goal frame proximally located to said shooting surface;

means for rotating said goal frame relative to said shooting surface.

26. An apparatus as recited in claim 25, further comprising a deflective panel for blocking a preselected portion of said goal frame opening.

* * * * *